US005785798A

United States Patent [19]

Horsman et al.

[11] Patent Number: 5,785,798

[45] Date of Patent: Jul. 28, 1998

[54] LABEL APPLYING APPARATUS

[75] Inventors: Dennis P. Horsman, Overland Park, Kans.; Christian J. Uebele, Kansas City, Mo.; Georg Austermeier, Hövelhof, Germany

[73] Assignee: Multivac, Inc., Kansas City, Mo.

[21] Appl. No.: 686,253

[22] Filed: Jul. 25, 1996

[51] Int. Cl.[6] ..... B65C 1/00

[52] U.S. Cl. ..... 156/361; 156/363; 156/521; 156/542

[58] Field of Search ..... 156/361, 540, 156/541, 542, 355, 363, 521, 556

[56] References Cited

U.S. PATENT DOCUMENTS

| | | | |
|---|---|---|---|
| 3,238,080 | 3/1966 | Schlutter | 156/542 X |
| 4,615,757 | 10/1986 | Treiber | 156/542 X |
| 5,133,827 | 7/1992 | Ratermann | 156/361 |

OTHER PUBLICATIONS

Belt-Fed Labellers dated Sep. 17, 1994, unnumbered, published in MR Etikettiertechnik Perfect Product Presentation.
Versatile Product Labelling dated Dec. 1, 1995, unnumbered, published in MR Etikettiertechnik Perfect Product Presentation.
MR-Etikettier System dated May 24, 1994, unnumbered, published in MR Etikettiertechnik Perfect Product Presentation.
Linear Labellers dated Mar. 9, 1991, unnumbered, published in MR Etikettiertechnik Perfect Product Presentation.
MR-Etikettier Systems dated Mar. 13, 1991, unnumbered, published in MR Etikettiertechnik Perfect Product Presentation.
Labelling Systems for Pharmaceutical Industry dated Apr. 7, 1995, unnumbered, published in MR Etikettiertechnik Perfect Product Presentation.
Labelling Solutions dated Apr. 23, 1995, unnumbered, published in MR Etikettiertechnik Perfect Product Presentation.

*Primary Examiner*—James Engel

*Attorney, Agent, or Firm*—Shook, Hardy & Bacon L.L.P.

[57] ABSTRACT

An apparatus is provided for applying adhesive labels, that are initially coupled together end-to-end in a label strip that has a non-adhesive backing material, onto a product. The apparatus has a frame with a supply container mounted thereto for containing a supply of the labels. A plurality of guide rollers is provided for guiding the strip of labels through the apparatus. A label sensor is mounted to the frame for detecting when an individual label has been moved past the label sensor. The frame further has mounted thereto an applicator head equipped with a stripper plate for removing the backing material from the label strip, which is thereafter wound onto a take-up container. The label strip and the removed backing material are moved with a supply motor that is mounted to the frame. The applicator head further has an applicator motor for rotating a break-away roller. Mounted directly beneath the break-away roller is an idler roller that cooperates with the break-away roller to hold a separated label in position. A product sensor is provided to detect a product needing to be labeled by the applicator head. Further a process is provided for separating an individual label from a series of labels and for applying the label to a product. The first step of the process involves detecting the presence of a product needing a label. Next, a first motor on the apparatus is activated to feed a label, held between a break-away roller and an idler roller, onto the product. A second motor is activated simultaneously with the first motor to feed a forward-most label from a strip of labels into the area vacated by the previous label. A backing strip is then peeled from the strip of labels as the forward-most label is fed forwardly by the second motor, thus exposing an adhesive material on the back of the strip of labels. The process further involves monitoring the label strip being advanced and determining when one complete label has been advanced. Next, when one complete label has been advanced, the first and second motors are deactivated, and a brake is applied to the label which immediately precedes the forward-most label, and the first motor is reactivated to separate the forward-most label from the remaining strip of labels.

13 Claims, 3 Drawing Sheets

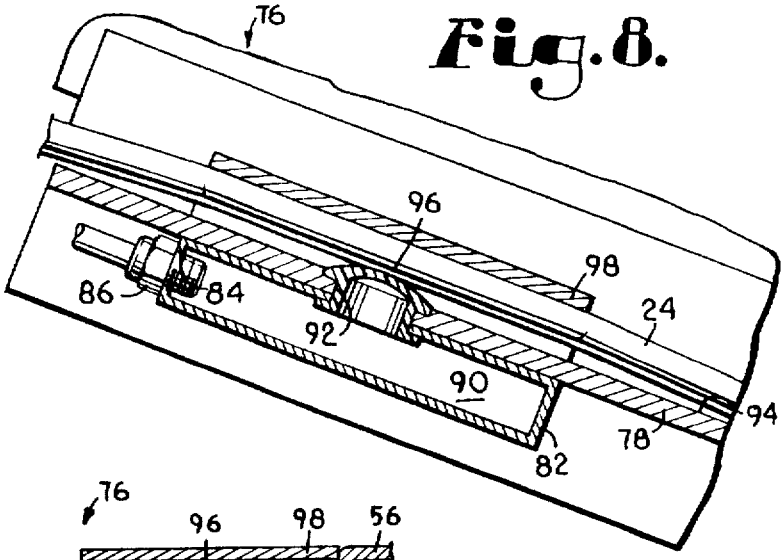
Fig. 8.
Fig. 9.
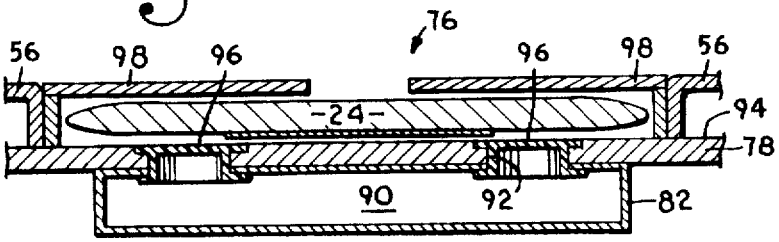
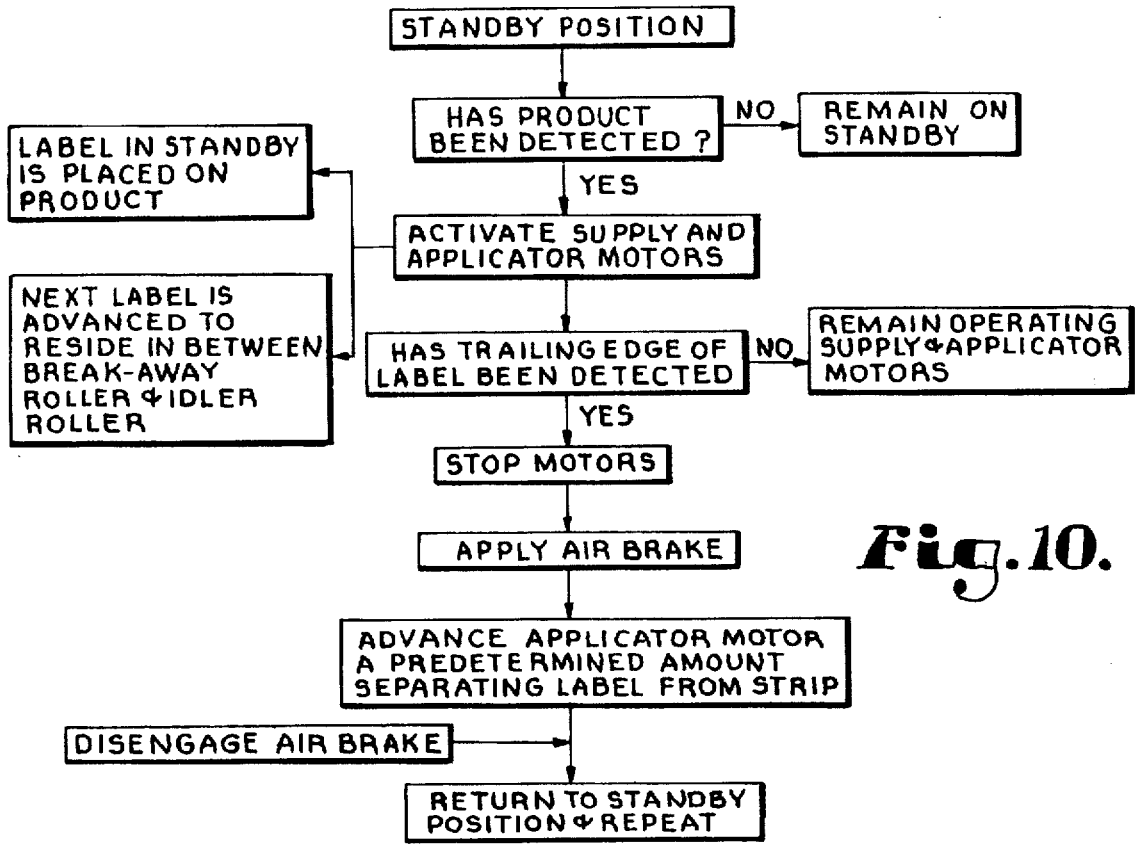
Fig. 10.

LABEL APPLYING APPARATUS

This application claims the benefit of U.S. provisional application Ser. No. 60/004,007, filed Sep. 20, 1995.

BACKGROUND OF THE INVENTION

The present invention relates to packaging technology, and, more particularly, to label application devices.

Labels are currently placed on a variety of products for a variety of reasons. The majority of labels placed on products are a single-ply label having an adhesive layer for adhering to a product. These labels are typically housed on a non-adhesive backing material prior to application, and are often contained, along with this backing material, on a large roll. Further, these labels are typically not connected to one another, but rather are placed separately on the backing material in spaced apart relation. To apply these labels, labeling machines are used to remove the labels from the backing material and to thereafter apply the labels to the product. The adhesive layer on the labels ensures that the applied labels remain in place.

It has become desirable in the labeling industry, however, to place a somewhat different kind of label, or label capsule on various products. Like regular labels, these label capsules are constructed with an adhesive layer, are housed on a non-adhesive backing material, and are typically contained on a large roll which can be used on an automatic packaging machine. The label capsules differ, however, from the traditional labels in several respects. First, these label capsules are actually small packages that are designed to operate in the same fashion as a label. The label capsules are designed to hold such things as folded coupons, instructions and cards. Second, the label capsules are initially connected to each other in end-to-end relation. Thus, the label capsules require separation before being placed on a product.

In a typical labeling environment, products are often presented to an automatic labeling machine at a constant feed rate. The labeling machine and the conveyor can communicate with one another so that the machine knows that the feeding conveyor is operating. Further, the labeling machine can be programmed to feed labels to correspond to the rate at which the feeding conveyor is supplying products. Thus, once the labeling machine is told that the conveyor is operating, the labeling machine will apply labels to the products at an appropriate rate.

A problem arises, however, in an environment in which the products are not supplied to the labeling machine at a constant rate. In this environment, the feeding conveyor is often running at a constant rate, and products needing to be labeled are sporadically placed on the feeding conveyor. Thus, even though the conveyor is operating, the labeling machine is not able to assume that products will be supplied to it at a constant rate corresponding to the speed of the conveyor. If the conveyor were to operate in the same fashion as in the constant feed rate environment, the labeling machine would be attempting to place labels on non-existing products. This problem is accentuated when it is desired to place label capsules on products because the label capsules require separation before being placed on the product.

Another problem that arises when label capsules are desired to be placed on products results from the fact that a different amount of force is needed to separate a label capsule from the remaining series of label capsules when different materials are used in making the label capsules. Thus, the force required to separate one type of label capsule may be different from the force required to separate a different type of label capsule.

Thus, a label applicating apparatus is needed that can apply labels to a sporadic supply of products. Further, a labeling apparatus is needed that can separate an individual label capsule from a series of label capsules. Still further, a labeling apparatus is needed that can be adjusted to vary the amount or time of separation force that is applied to separate an individual label capsule from a series of label capsules. A label applicating apparatus is also needed that can distinguish when an individual label has been advanced.

SUMMARY OF THE INVENTION

Accordingly, it is an object of the present invention to provide a label applicating apparatus that can apply individual label capsules to products being sporadically supplied to the apparatus.

A further object of this invention is to provide an apparatus that can separate an individual label capsule from a series of label capsules.

Another object of this invention is to provide a labeling apparatus in which the label capsule separating force can be varied to accommodate a variety of different grades and types of label capsules.

Yet another object of this invention is to provide a label application apparatus that can identify individual label capsules and that can indicate when one individual label capsule has been advanced.

According to the present invention, the foregoing and other objects are obtained by an apparatus for applying adhesive labels or label capsules that are initially coupled to a removable backing material and to each other in end-to-end relation, onto a product. The apparatus has a frame on which is mounted a supply reel that can hold a supply of label capsules. The apparatus further has a series of guide rollers for guiding the labels from the supply reel to an applicator head. The applicator head of the apparatus has a stripper plate for separating a non-adhesive backing material from the series of label capsules which is fed onto a take-up reel for storage and eventual disposal. A supply motor is mounted to the frame for moving the labels from the supply reel through the guide rollers to the applicator head, and for moving the backing material onto the take-up reel. The applicator head also has a separator mechanism for separating an individual label capsule from the series of label capsules and an applicating mechanism for applying the separated label capsule onto a product. A product sensor is supplied for detecting the approach of a product needing to be labeled, and a label sensor is supplied for detecting when one individual label capsule has been advanced.

Additional objects, advantages, and novel features of the invention will be set forth in part in the description which follows, and in part will become apparent to those skilled in the art upon examination of the following, or may be learned from practice of the invention. The objects and advantages of the invention may be realized and attained by means of the instrumentalities and combinations particularly pointed out in the appended claims.

BRIEF DESCRIPTION OF THE DRAWINGS

In the accompanying drawings which form a part of the specification and are to be read in conjunction therewith and in which like reference numerals are used to indicate like parts in the various views:

FIG. 8 is a view similar to FIG. 6 showing the brake of the label application apparatus in an engaged position;

FIG. 9 is an enlarged cross-sectional view of taken along line 9—9 of FIG. 3; and FIG. 10 is a flow chart indicating the process of using the label application apparatus of FIG. 1.

DETAILED DESCRIPTION OF THE PREFERRED EMBODIMENT

Figure 1:
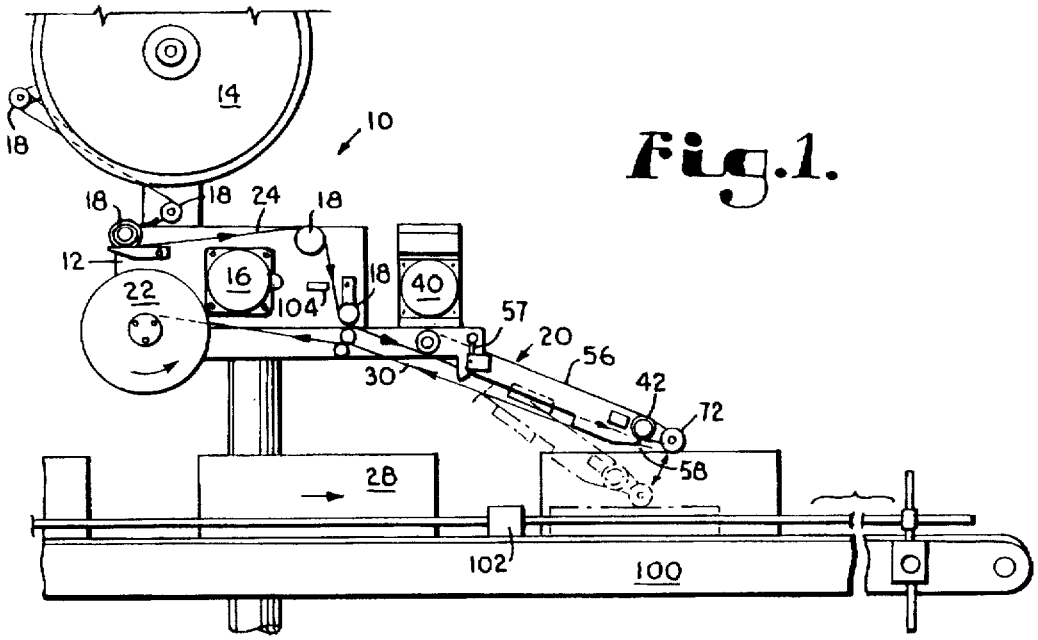
FIG. 1 is a side elevation view of a label application apparatus according to the present invention.
Figure 2:
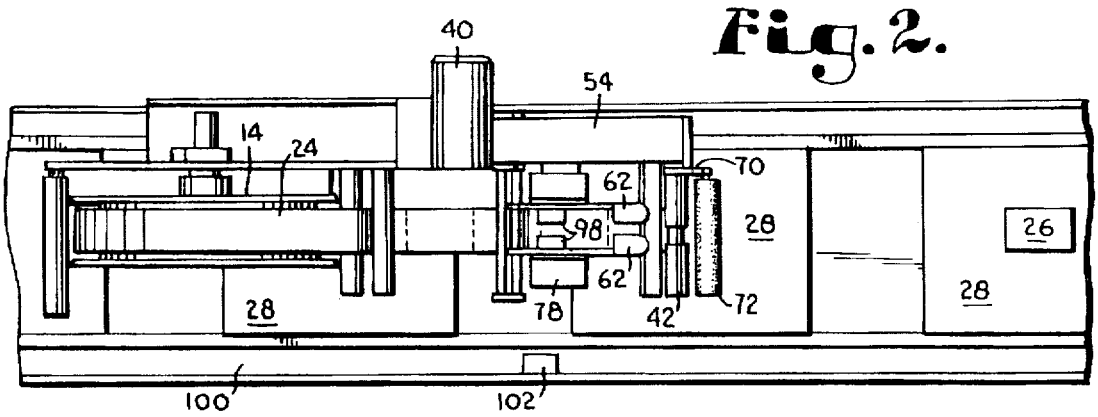
FIG. 2 is a top plan view of the label application apparatus of FIG. 1.
Figure 4:
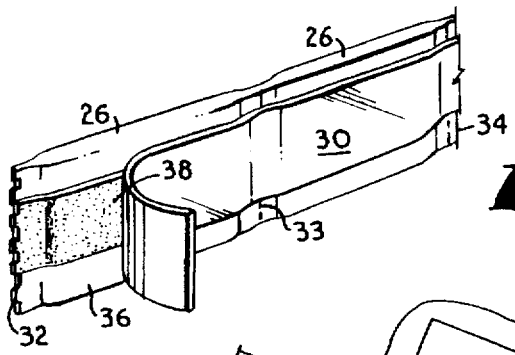
FIG. 4 is an enlarged perspective view of the label strip supplied to the label application apparatus of FIG. 1, shown with the backing material partially removed.

Referring now to the drawings in greater detail, and initially to FIG. 1, a label application apparatus made in accordance with the present invention is broadly designated by the numeral 10. Apparatus 10 generally includes a frame 12 on which is mounted a supply reel 14, a supply motor 16, a series of guide rollers 18, an applicator head 20 and a take-up reel 22. A label strip 24, as best seen in FIGS. 1, 2 and 4, is initially housed on supply reel 14 and is fed by supply motor 16 around guide rollers 18 to applicator head 20. Applicator head 20 applies a label capsule 26 to a product 28. Prior to this application a non-adhesive backing material 30 is removed from label strip 24 by applicator head 20. Backing material 30 is thereafter fed by supply motor 16 to take-up reel 22.

As can best be seen in FIG. 4, label strip 24 is composed of a series of label capsules 26 having forward edges 32 and rearward edges 34. A forward edge 32 of one label capsule is joined along a perforation 33 to a rearward edge 34 of another label capsule. Applied to a bottom 36 of label capsule 26 is an adhesive layer 38 that is used to couple label capsule 26 to product 28. Backing material 30 initially covers adhesive layer 38 to protect layer 38 until such time as label capsule 26 is desired to be placed on product 28. Backing material 30 is not perforated along the joint between successive label capsules, but rather is a continuous strip of material. As stated above, label strip 24 is initially contained on supply reel 14 and is fed to applicator head 20 by supply motor 16. Supply motor 16 is preferably a programmable stepping motor capable of moving an output shaft a predetermined radial distance. Applicator head 20 is used to apply an individual label capsule from strip 24 onto product 28. Since label capsules 26 initially have backing material 30 thereon and since label capsules 26 are initially joined together, applicator head 20 must remove backing material 30 and separate an individual label-capsule from strip 24 prior to application on product 28.

Applicator head 20 has an applicator motor 40 that transmits power to a break-away roller 42. Applicator motor 40 is preferably mounted to frame 12 and is preferably a programmable stepping motor similar to supply motor 16 that is capable of moving an output shaft 44, shown in FIG. 3, in discrete radial steps. As discussed more fully below, break-away roller 42 is used to both apply label capsule 26 and separate label capsule 26 from strip 24. Break-away roller 42 has a gap 43 therein so that pressure is not applied in the region of adhesive layer 38. Disposed on output shaft 44 is a timing pulley 46 that is coupled, via a timing belt 48, to a timing pulley 50 on a roller shaft 52 of break-away roller 42. Thus, break-away roller 42 will move in relation to movement of output shaft 44 of motor 40. A housing 54 covers output shaft 44, timing pulleys 46 and 50 and timing belt 48.

Figure 3:
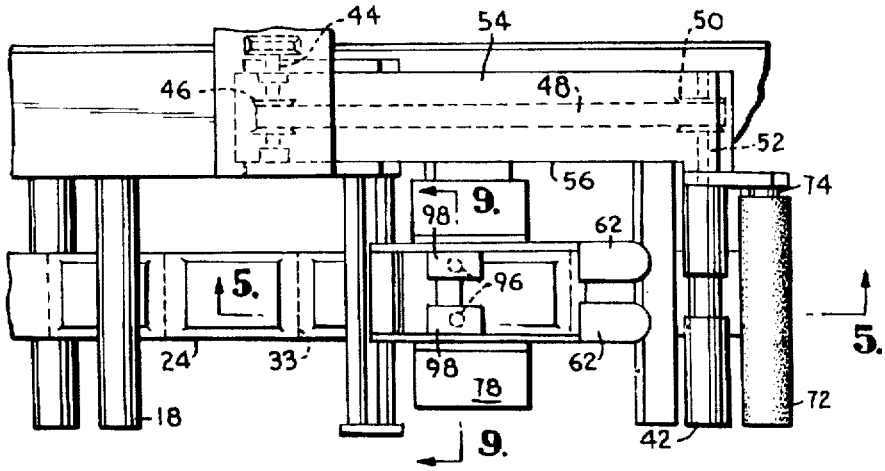
FIG. 3 is an enlarged top plan view of one section of the label application apparatus of FIG. 1.
Figure 5:
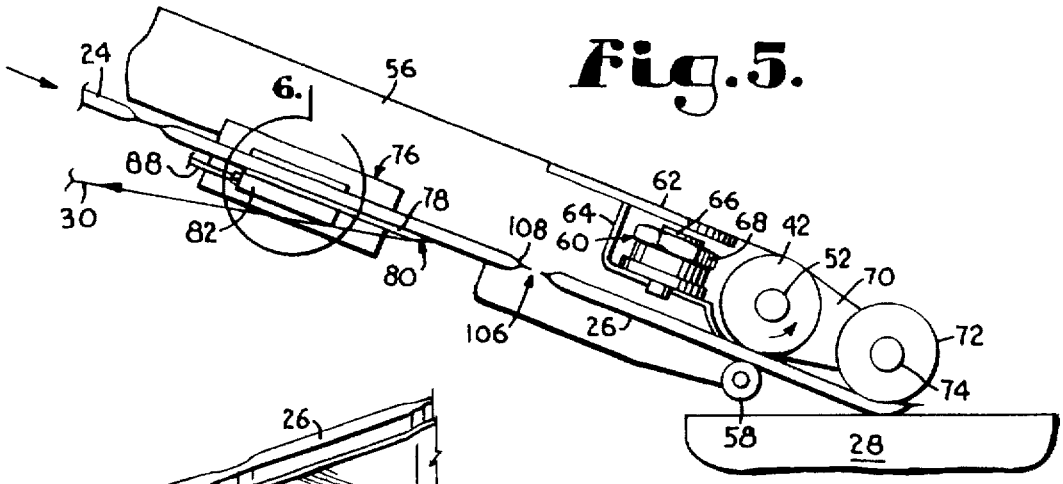
FIG. 5 is a cross-sectional view taken along line 5—5 of FIG. 3, with a label shown in a standby position.

Break-away roller 42 is held in the proper position above product 28 by a body 56. Applicator head 20 and thus body 56 are coupled to a radial slot 57 in frame 12, as best seen in FIG. 1, to accommodate different sizes of products 28. As shown in phantom lines in FIG. 1, applicator head 20 can be pivoted relative to frame 12 to accommodate lower profile products 28. Mounted to body 56 in spaced relation below break-away roller 42 is an idler roller 58. Idler roller 58 has a gap (not shown) in corresponding width to gap 43 so that label capsule 26 is not held between break-away roller 42 and idler roller 58 in the region of adhesive layer 38. The tension placed on idler roller 58 is adjustable with a tension mechanism 60 mounted to body 56. As best seen in FIG. 3 and 5, body 56 has a pair of tension plates 62 extending therefrom. Mounted directly beneath tension plates 62 is a pair of adjustable arms 64 that are used to apply tension to idler roller 58. Each arm 64 has disposed thereon a tension bolt 66 and a nut 68. Increased tension can be placed on idler roller 58 by adjusting the position of tension bolt 66 and thereafter locking bolt 66 in place with nut 68. Moving bolt 66 upwardly causes bolt 66 to press against tension plates 62, thus causing a downward force and increased tension on idler roller 58.

An extension arm 70, coupled to a bearing (not shown) on roller shaft 52, is used to mount a pressure roller 72 having a shaft 74 in front of break-away roller 42. The bearing allows roller shaft 52 to move while maintaining arm 70 in a stationary position. Pressure roller 72 is pivotally adjustable relative to break-away roller 72 by radially adjusting arm 70, and is freely movable on shaft 74. Pressure roller 72 is used to positively apply label capsule 26 to product 28, as described more fully below.

Figure 6:
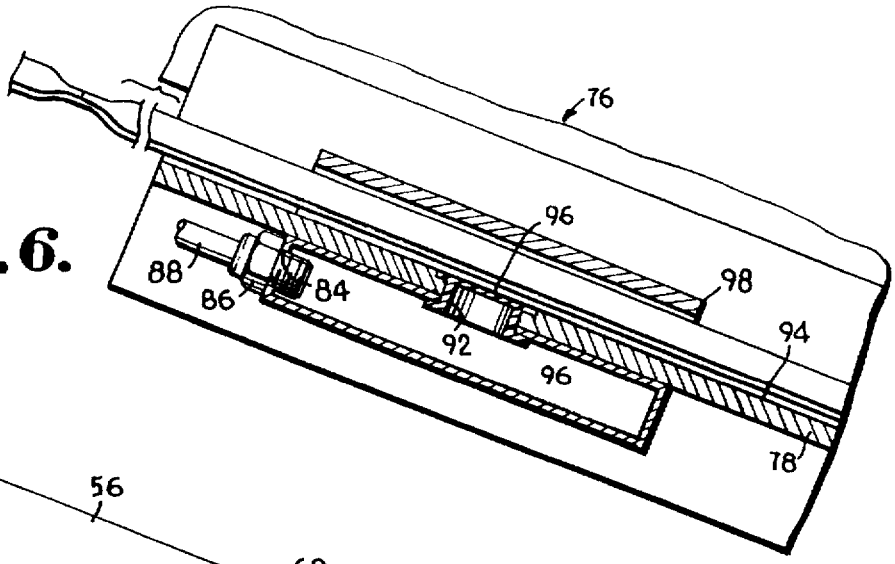
FIG. 6 is an enlarged cross-sectional view of the area contained within the circled region (6) of FIG. 5 showing the brake of the label application apparatus in a disengaged position.

As stated above, before label capsule 26 can be applied to product 28 it must first be separated from label strip 24. As best seen in FIGS. 5 and 6, mounted to applicator head 20 on body 56 is a separator mechanism 76 that is used to separate an individual label from strip 24. Mechanism 76 has a stripper plate 78 having a radiused front surface 80 for removing backing material 30 from label strip 24. Further, mounted in air-tight relation to, and directly beneath, stripper plate 78 is an air manifold 82 having an air-inlet port 84. A fitting 86, having an air supply line 88 connected thereto, is threaded into port 84. Port 84 thus connects supply line 88 with an internal cavity 90 of air manifold 82. A pair of diaphragm mounting holes 92 run from a top surface 94 of stripper plate 78 through stripper plate 78, accessing internal cavity 90. Located in each diaphragm mounting hole 92 is a flexible diaphragm brake 96. Diaphragm brake 96 is connected to stripper plate 78 and manifold 82 in fluid-tight communication. Thus, brake 96 does not allow air supplied by line 88 to escape internal cavity 90. Mounted to top surface 94 of stripper plate 78 directly above diaphragm brakes 96 are a pair of brake plates 98. Brake plates 98 are spaced a sufficient distance away from top surface 94 to allow label strip 24 to pass between stripper plate 78 and plates 96.

As best shown in FIG. 6 and 9, when air is not supplied to internal cavity 90 by line 88, the top of diaphragm brake 96 is flush with top surface 94 of stripper plate 78. Label strip 24 is thus allowed to pass between top surface 94 and brake plates 98. When air is supplied to internal cavity 90 by line 88, the diaphragm brakes 96 deform upwardly, as best seen in FIG. 8. The spacing between top surface 94 and brake plates 98 is such that when brakes 96 deform upwardly, label strip 24 is pressed against brake plates 98. Label strip 24 is thus prevented from further movement until diaphragm brakes 96 are allowed to return to a nondeformed state, flush with top surface 94, by exhausting air through line 88.

Products 28 are supplied to apparatus 10 by a conveyor 100. Conveyor 100 is optionally mounted to frame 12. Mounted to conveyor 100 is a product sensor 102. Product sensor 102 is positioned on conveyor 100 at a location preceding break-away roller 42. Product sensor 102 is used to detect the presence of an oncoming product 28, on conveyor 100, that is to be labeled. Cooperating with product sensor 102, as is more fully described below, is a label sensor 104, shown in FIG. 1. Label sensor 104 is mounted on frame 12 prior to applicator head 20, and is used to detect the movement of one complete label past label sensor 104.

In operation, a strip of labels is placed on supply reel 14 and threaded through guide rollers 18 and between stripper plate 78 and brake plates 98. Backing material 30 is removed from strip 24 by front surface 80 of stripper plate 78. Backing material 30 is threaded rearwardly to take-up reel 22. Referring to FIGS. 5 and 10, an individual label capsule 26 is shown in FIG. 5 in a standby position between break-away roller 42 and idler roller 58. Label capsule 26 has already been separated from strip 24 by the process described below, as can be seen by the break-point 106 in FIG. 5. Label capsule 26 is thus ready to be applied to product 28 needing a label. In the standby position, diaphragm brakes 96 are not deformed, and are thus flush with top surface 94 of stripper plate 78. Further, in the standby position, the trailing edge of an individual label capsule 26 will be located directly in front of label sensor 104. The standby condition thus described corresponds to the standby position shown at the top of FIG. 10.

Figure 7:
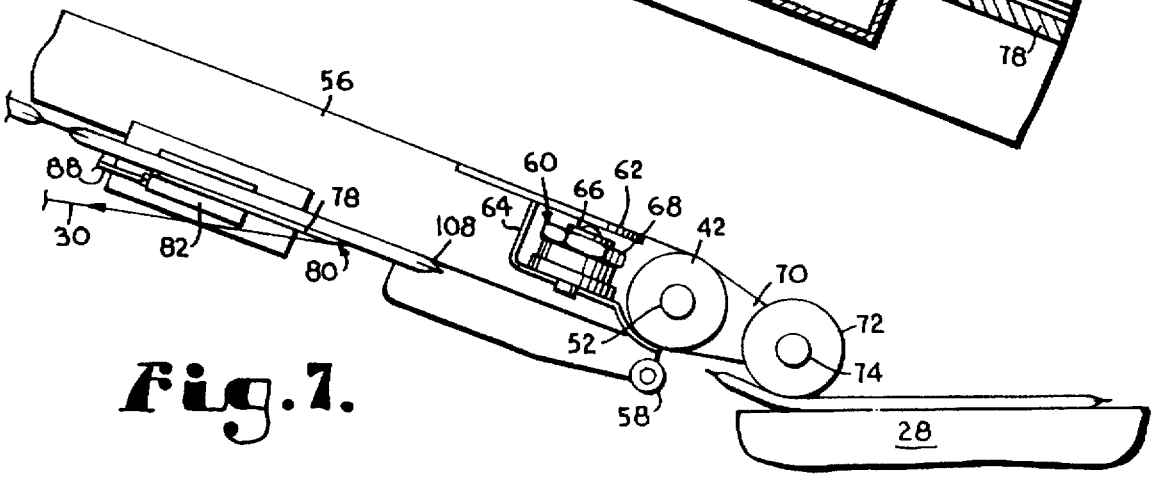
FIG. 7 is a view similar to FIG. 5 with a label shown being applied to a product.

A product 28 needing to be labeled is then placed on conveyor 100 either manually or mechanically and is carried by conveyor 100 towards applicator head 20. Product 28 is detected as it passes by product sensor 102. As shown in FIG. 10, apparatus 10 will remain in the standby position until product 28 has been detected. After product 28 is detected by product sensor 102, supply motor 16 and applicator motor 40 are activated. Activating applicator motor 40 and supply motor 16 results in the label capsule 26 in standby position being placed on product 28 while the forward-most label capsule 26 on strip 24 is simultaneously advanced to a position between break-away roller 42 and idler roller 58, as shown in FIG. 10. Activating applicator motor 40 causes break-away roller 42 to rotate. As break-away roller 42 rotates, idler roller 58 is caused to rotate as well. The tension placed on idler roller 58 can be adjusted as described above to ensure that idler roller 58 rotates properly along with break-away roller 42. Because label capsule 26 is held between break-away roller 42 and idler roller 58, label capsule 26 is advanced forwardly from the standby position as break-away roller 42 rotates. As label capsule 26 advances it is placed on product 28 by pressure roller 72. As pressure roller 72 exerts a downward force on label capsule 26 adhesive layer 38 couples label capsule 26 to product 28, as best seen in FIG. 7.

As stated above, after product 28 is detected, supply motor 16 is activated simultaneously with applicator motor 40. Activating supply motor 16 advances label strip 24 from supply reel 14. As label strip 24 is advanced over stripper plate 78, backing material 30 is removed, as best seen in FIGS. 5 and 7. Backing material 30 is wound onto take-up reel 22 at the same rate as label strip 24 is advanced. Further, as label strip 24 is advanced, a leading edge 108 of label strip 24 is fed into the space between break-away roller 42 and idler roller 58, which is now vacant as label capsule 26 has been applied to product 28 as described above. Gap 43 in break-away roller 42 and the corresponding gap in idler roller 58, allow label strip 24 to advance between break-away roller 42 and idler roller 58 without interference from adhesive layer 38. Because applicator motor 40 is still activated at this time, label strip 24 will be further advanced between break-away roller 42 and idler roller 58 through the rotation of break-away roller 42.

As supply motor 16 advances label strip 24, label sensor 104 monitors the advancing strip to determine when one label capsule 26 has passed by label sensor 104. As stated above, in standby position, the trailing edge of a label capsule is located in front of label sensor 104. As shown in FIG. 10, when the trailing edge of the preceding label is located in front of label sensor 104 supply motor 16 and applicator motor 40 are deactivated. Label sensor 104 thus detects the presence of the trailing edge, indicating that label strip 24 has advanced one complete label capsule 26 whereupon supply motor 16 and applicator motor 40 are deactivated.

Still referring to FIG. 10, after deactivating supply motor 16 and applicator motor 40, an air brake is applied to label strip 24. Air supplied by air line 88 to internal cavity 90 of air manifold 82 causes diaphragm brakes 96 to deform upwardly, holding label strip 24 against brake plates 98. Diaphragm brakes 96 are shown in a deformed state in FIG. 8.

Applicator motor 40 is thereafter reactivated for a predetermined time or radial distance to separate label capsule 26 from strip 24 as shown in FIG. 10. Reactivating applicator motor 40 causes break-away roller 42 to rotate, thus pulling the forward-most label capsule 26 of label strip 24. As the forward-most label capsule 26 is pulled forwardly, stress is placed upon perforation 33 because the remainder of label strip 24 is being held firmly in place by diaphragm brakes 96. Perforation 33 represents the weakest point on label strip 24 between the forward-most label capsule 26 and brakes 96. Therefore, as break-away roller 42 advances the forward-most label capsule 26, the forward-most label capsule 26 is caused to separate from label strip 24 at perforation 33. Applicator motor 40 is programmed to move only enough to separate the forward-most label capsule 26 from label strip 24. Further, motor 40 can be adjusted to move more or less as needed to separate label capsule 26 from strip 24 when different label capsule materials are used. After advancing the pre-programmed amount, applicator motor 40 is deactivated. At this time, the forward-most label capsule 26 is in the standby position described above and is ready for application to the next product 28.

After applicator motor 40 has been deactivated, the air brake is disengaged, as shown in FIG. 10. To disengage diaphragm brakes 96, air is exhausted from internal cavity 90, thus returning diaphragm brakes 96 to a position flush with top surface 94 of stripper plate 78. At this point, as shown in FIG. 10, apparatus 10 returns to a standby position. Apparatus 10 remains in this standby condition until another product 28 is detected by product sensor 102, whereupon the above process is repeated.

The present invention further involves a process for separating an individual label from a series of labels and thereafter applying the label capsule to a product. The first step of the process involves detecting the presence of a product needing a label as the product travels down a conveyor. In the second step, a first motor on the apparatus is activated to feed a label, held between a break-away roller and an idler roller, onto the product. A second motor is activated simultaneously with the first motor to feed a forward-most label from a strip of labels into the area vacated by the previous label. The process further requires peeling a backing strip from the strip of labels as the forward-most label is fed forwardly by the second motor, thus exposing an adhesive material on the back of the strip of labels. Next, the backing strip is wound onto a take-up reel for later disposal. The process further involves monitoring the label strip being advanced by the second motor and determining when one complete label has been advanced. Next, when one complete label has been advanced, the first and second motors are deactivated, stopping the movement of the strip of labels. A brake is then applied to the label which immediately precedes the forward-most label. The process next involves reactivating the first motor to separate the forward-most label from the remaining strip of labels. At this stage the process is ready for repetition, upon detecting the presence of another approaching product that needs a label.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, what is claimed is:

1. A label application apparatus for applying adhesive labels onto a product, the labels being initially coupled to a removable backing material and to each other in end-to-end relation, the apparatus comprising:

a frame;

a supply container, mounted to said frame, for containing a supply of the labels;

a label sensor for detecting a part of an individual label;

an applicator head mounted to said frame, said applicator head having a stripper plate for separating the labels from the backing material, means for separating an individual label from the supply of labels connected in end-to-end relation, means for advancing said individual label to a standby position, and means for applying the individual label onto the product;

a product sensor for detecting a product approaching said applicator head;

a take-up container for containing an amount of said backing material after separation from said labels;

a supply motor for moving the labels from said supply container to said applicator head and for moving the backing material from said applicator head to said take-up container; and control means for controlling said applying means so that an individual label in said standby position is applied to the approaching product after said product sensor detects the approaching product, and for controlling said separating means, said advancing means and said supply motor so that only one individual label, as detected by said label sensor, is thereafter separated and advanced into said standby position.

2. The apparatus of claim 1, wherein said applicator head is pivotally mounted to said frame to allow said applicator head to be used for a variety of product sizes.

3. The apparatus of claim 2, further comprising a plurality of guide rollers, mounted in spaced relation on said frame, for guiding the labels from said supply reel to said applicator head.

4. The apparatus of claim 3, further comprising a conveyor for moving the product past said product sensor and into a contacting relationship with said applicator head.

5. The apparatus of claim 1, wherein said applicating means includes:

an applicator motor;

a break-away roller coupled to an output shaft of said applicator motor;

an idler roller mounted directly beneath said break-away roller, said break-away roller and said idler roller cooperating to securely hold a forward-most label of the supply of labels that is fed between said break-away roller and said idler roller by said supply motor and said applicator motor; and a pressure roller, wherein said control means activates said applicator motor when the approaching product is detected by said product detector, said applicator motor activating said break-away roller and advancing the label in said standby position towards the product, said pressure roller acting to positively apply the label onto the product.

6. The apparatus of claim 5, wherein said supply motor and said applicator motor are stepping motors each having an output shaft and operable to rotate said shaft a predetermined radial distance.

7. The apparatus of claim 6 wherein said separating means comprises a brake for holding a label immediately preceding the forward-most label, said brake cooperating with said applicating means and said control means to achieve label separation, said control means activating said brake after said supply motor and said applicator motor have been deactivated after having advanced one complete label, as indicated by said label sensor, wherein said control means thereafter reactivates said separator motor to advance only the forward-most label, separating the forward-most label from the preceding label, said forward-most label thus residing in said standby position between said break-away roller and said idler roller.

8. The apparatus of claim 7, wherein said brake is a pneumatic brake that includes:

an air manifold having an inlet port and a pneumatically activated diaphragm; and a brake plate located in spaced relation directly above said diaphragm, the labels being fed between said manifold and said brake plate, wherein said diaphragm is displaced upwardly when said brake is activated, thereby holding said labels securely between said diaphragm and said brake plate.

9. A label application apparatus for applying adhesive labels onto a product, the labels being initially coupled to a removable backing material and to each other in end-to-end relation, said apparatus comprising:

a frame;

a supply container, mounted to said frame, for containing a supply of the labels;

a label sensor for detecting a part of an individual label;

an applicator head mounted to said frame, said applicator head having a body for guiding said labels through said applicator head, a stripper plate mounted on said body for separating the labels from the backing material, an applicator motor coupled to said body having an output shaft coupled to a break-away roller, an idler roller mounted directly beneath said break-away roller, and a brake;

a product sensor for detecting a product approaching said applicator head;

a plurality of guide rollers, mounted in spaced relation on said frame, for guiding the labels from said supply reel to said applicator head;

a take-up container for containing an amount of said backing material after separation from said labels; and a supply motor for moving the labels from said supply container through said guide rollers to said applicator head, and for moving said backing material onto said take-up container, said supply motor cooperating with said separator motor to advance an individual label into a standby position, and with said label sensor to advance only one individual label into said standby position, wherein said separator motor is activated after said product sensor detects an approaching product, thereby activating said break-away roller to apply the individual label, located in said standby position, onto the product.

10. A process of separating an individual label from a series of labels connected end-to-end and applying the individual label to a product, the process comprising:

detecting the presence of a product needing to be labeled;

activating both a first motor that feeds a label, having previously been separated, onto the product, and a second motor that feeds a forward-most label from a remaining series of labels between a break-away roller and an idler roller, said first motor acting to advance said forward-most label further between said break-away roller and said idler roller;

removing a backing material from the forward-most label, thereby exposing an adhesive material on the label;

detecting when one complete label has been advanced;

deactivating said first and said second motors; and separating the forward-most label from the remaining series of labels, the forward-most label thereby being ready for application onto the next product.

11. The process of claim 10, wherein said separating step includes applying a brake to hold the label immediately preceding the forward-most label and thereafter reactivating said first motor to further advance only the forward-most label between said break-away roller and said idler roller.

12. The process of claim 11, further comprising feeding said labels from a supply container for containing a supply a labels and winding said backing material onto a take-up container.

13. The process of claim 12, further comprising pressing the label onto the product with a pressure roller.

* * * * *